US010733952B2

(12) United States Patent
Lin et al.

(10) Patent No.: US 10,733,952 B2
(45) Date of Patent: Aug. 4, 2020

(54) MULTIPLEXER APPLIED TO DISPLAY DEVICE

(71) Applicant: AU Optronics Corporation, Hsin-Chu (TW)

(72) Inventors: Yi-Cheng Lin, Hsin-Chu (TW); Ming-Hsien Lee, Hsin-Chu (TW); Kai-Wei Hong, Hsin-Chu (TW); Chun-Da Tu, Hsin-Chu (TW); Chuang-Cheng Yang, Hsin-Chu (TW); Chun-Feng Lin, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 16/111,531

(22) Filed: Aug. 24, 2018

(65) Prior Publication Data

US 2019/0066622 A1 Feb. 28, 2019

(30) Foreign Application Priority Data

Aug. 24, 2017 (TW) ..... 106128838 A

(51) Int. Cl.
*G09G 3/36* (2006.01)

(52) U.S. Cl.
CPC ... *G09G 3/3688* (2013.01); *G09G 2300/0426* (2013.01); *G09G 2300/0809* (2013.01); *G09G 2310/0297* (2013.01); *G09G 2330/06* (2013.01)

(58) Field of Classification Search
CPC ..... G09G 3/3688; G09G 3/36; G09G 3/32; G09G 2330/06; G09G 2310/0297; G09G 2300/0426; G09G 2300/0809
See application file for complete search history.

(56) References Cited

U.S. PATENT DOCUMENTS

2005/0024316 A1* 2/2005 Ohta ..... G09G 3/3688 345/100
2005/0134541 A1* 6/2005 Jang ..... G09G 3/3688 345/94
2014/0092076 A1* 4/2014 Lee ..... G09G 3/3291 345/212

FOREIGN PATENT DOCUMENTS

CN 103971625 A 8/2014
TW 200400381 A 1/2004

OTHER PUBLICATIONS

Office Action issued by the State Intellectual Property Office of the Peoples Republic of China dated Sep. 17, 2019 for Application No. CN201711120056.0.

* cited by examiner

*Primary Examiner* — Brent D Castiaux
(74) *Attorney, Agent, or Firm* — Tim Tingkang Xia, Esq.; Locke Lord LLP

(57) ABSTRACT

A multiplexer applied to a display device includes: a plurality of switching units, electrically coupled to a data driver and a plurality of pixel units, where the switching units are adapted to receive a plurality of input display data signals output by the data driver, and the switching units output a plurality of output display data signals to the electrically coupled pixel units, where each of the switching units includes a plurality of switch units, configuration locations of the switch units in each of the switching units are the same as, and some of the switch units configured at a same configuration location in the different switching units are electrically coupled to different control signal lines and have different wiring lengths, where the wiring lengths are distances between the switch units and the control signal lines.

15 Claims, 7 Drawing Sheets

MULTIPLEXER APPLIED TO DISPLAY DEVICE

CROSS-REFERENCE TO RELATED PATENT APPLICATION

This non-provisional application claims priority to and the benefit of, pursuant to 35 U.S.C. § 119(a), patent application Serial No. 106128838 filed in Taiwan on Aug. 24, 2017. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to a multiplexer, and in particular, to a multiplexer applied to a display device.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A conventional display device such as a crystal liquid display device includes a display panel having a plurality of rows of pixels, and may have a touch sensing function in cooperation with a touch panel. When the crystal liquid display device intends to perform display, the pixels are charged progressively by using display data, so that the crystal liquid display device may perform display according to the display data. However, in recent years, because the resolution of the crystal liquid display device is increased, within a period of time of displaying a frame, the crystal liquid display device needs to drive more rows of pixels. To effectively reduce a quantity of signal wiring and an occupied area, a display device transfers display data in cooperation with a multiplexer. However, when the parasitic capacitance of the multiplexer is larger, the multiplexer is more susceptible to an alternating-current signal. As a result, the display device generates a relatively large noise. Therefore, how to effectively reduce the parasitic capacitance of the multiplexer is one of the currently important tasks.

SUMMARY

To resolve the foregoing defects, the present invention puts forward an embodiment of a multiplexer applied to a display device. The multiplexer includes: a plurality of switching units, electrically coupled to a data driver and a plurality of pixel units, where the switching units are adapted to receive a plurality of input display data signals output by the data driver, and the switching units output a plurality of output display data signals to the electrically coupled pixel units, where each of the switching units includes a plurality of switch units, configuration locations of the switch units in each of the switching units are the same as, and some of the switch units configured at a same configuration location in the different switching units receive different control signals.

The present invention further puts forward an embodiment of a multiplexer applied to a display device. The multiplexer includes: a plurality of switching units, electrically coupled to a data driver and a plurality of pixel units, where the switching units are adapted to receive a plurality of input display data signals output by the data driver, and the switching units output a plurality of output display data signals to the electrically coupled pixel units, where each of the switching units includes a plurality of switch units, configuration locations of the switch units in each of the switching units are the same as, and some of the switch units configured at a same configuration location in the different switching units are electrically coupled to different control signal lines and have different wiring lengths, where the wiring lengths are distances between the switch units and the control signal lines.

According to the present invention, some of switch units configured at a same configuration location in different switching units are electrically coupled to different control signal lines and have different wiring lengths, that is, some of switch units configured at a same configuration location in different switching units are correspond to different control signal lines and control signals. Therefore, the wiring lengths corresponding to the control signals may be averaged, thereby effectively reducing and balancing a parasitic capacitance value generated corresponding to a same control signal, and then effectively reducing a noise of a display panel.

These and other aspects of the present disclosure will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

The detailed features and advantages of the present invention are described below in great detail through the following embodiments, and the content of the detailed description is sufficient for persons skilled in the art to understand the technical content of the present invention and to implement the present invention there accordingly. Based upon the content of the specification, the claims, and the drawings, persons skilled in the art can easily understand the relevant objectives and advantages of the present invention. The following embodiments further describe the viewpoints of the present invention, but are not intended to limit the scope of the present invention in any way.

Figure 1:
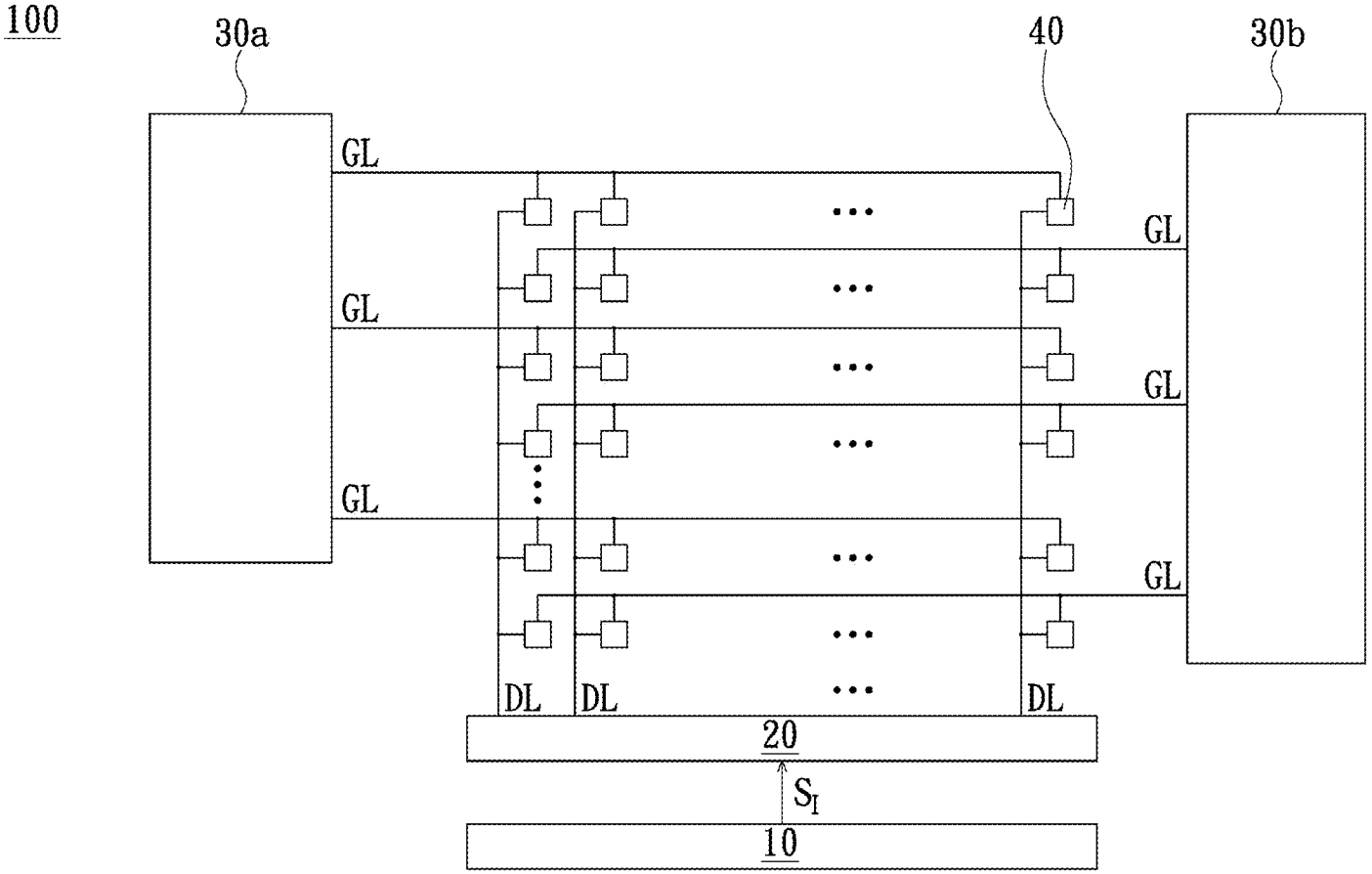
FIG. 1 is a schematic diagram of an embodiment of a display device.

First referring to FIG. 1, FIG. 1 is a schematic diagram of an embodiment of a display device 100. The display device 100 is, for example, a crystal liquid display or a light emitting diode display, but is not limited thereto. The display device 100 includes a data driver 10, a multiplexer 20, a gate driver 30, and a plurality of pixel units 40. The data driver 10 is electrically coupled to the multiplexer 20, and the data driver 10 is adapted to output a plurality of input display data signals $S_I$ to the multiplexer 20. The multiplexer 20 is electrically coupled to each pixel unit 40 by using a data line DL, the multiplexer 20 is adapted to output a plurality of display data signals $S_O$ according to the input display data signals $S_I$, and the multiplexer 20 transfers the display data signals $S_O$ to corresponding data lines DL. The gate driver 30 is electrically coupled to each pixel unit 40 by using a gate line GL, and the gate driver 30 is adapted to output a plurality of gate driving signals G to the electrically coupled pixel units 40. In this embodiment, an example in which the display device 100 includes a gate driver 30*a* and a gate driver 30*b* is used, but the present invention is not limited thereto. Each pixel unit 40 is adapted to receive a corresponding display data signal $S_O$ by using an electrically coupled data line DL and receive a corresponding gate driving signal G by using an electrically coupled gate line GL, and each pixel unit 40 determines, according to the received gate driving signal G, whether to receive the display data signal $S_O$.

Figure 2A:
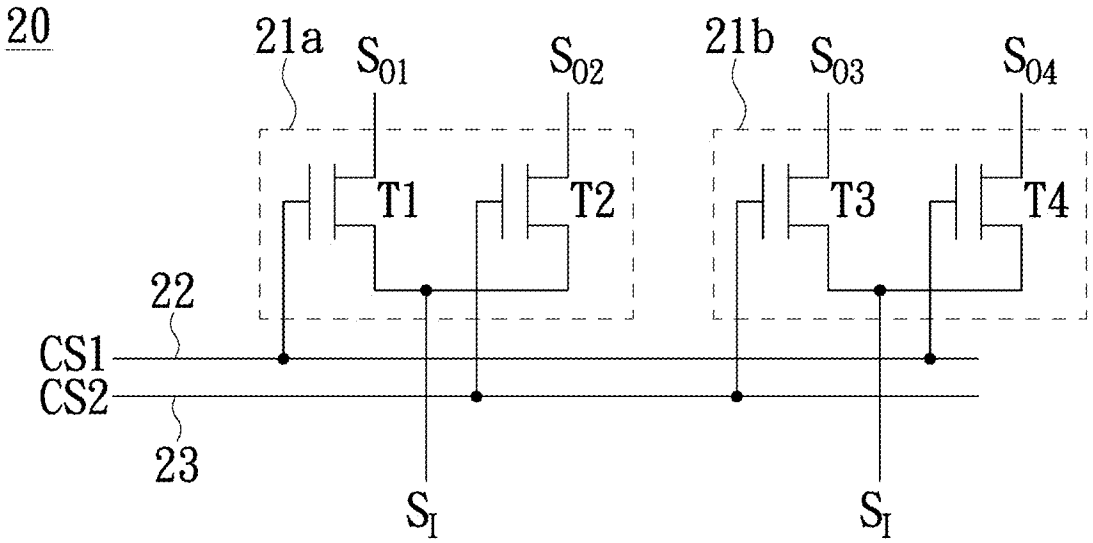
FIG. 2A is a schematic diagram of a first equivalent circuit embodiment of a multiplexer according to the present invention.

Then referring to FIG. 2A, FIG. 2A is a schematic diagram of a first equivalent circuit embodiment of a multiplexer 20 according to the present invention. The multiplexer 20 includes a plurality of switching units 21. In this embodiment, the multiplexer 20 includes at least one first switching unit 21*a* and one second switching unit 21*b*, but the present invention is not limited thereto. Each switching unit 21 is electrically coupled to a data driver 10 and a plurality of pixel units 40, the switching unit 21 is adapted to receive a plurality of input display data signals $S_I$ output by the data driver, and the switching unit 21 and outputs the input display data signals $S_I$ as output display data signals $S_O$ and transfers the output display data signals $S_O$ to the electrically coupled pixel units 40. As shown in FIG. 2A, the switching unit 21*a* outputs an output display data signal $S_{O1}$ and an output display data signal $S_{O2}$, and the switching unit 21*b* outputs an output display data signal $S_{O3}$ and an output display data signal $S_{O4}$.

Each switching unit 21 includes a plurality of switch units. In this embodiment, each switching unit 21 includes two switch units, but the present invention is not limited thereto. The switching unit 21*a* includes a first switch unit T1 and a second switch unit T2, the first switch unit T1 has a first terminal, a control terminal, and a second terminal, the first terminal of the first switch unit T1 is adapted to receive the foregoing input display data signal $S_I$, the control terminal of the first switch unit T1 is electrically coupled to a first control signal line 22 and receives a first control signal CS1, the second terminal of the first switch unit T1 is electrically coupled to one of the data lines DL in FIG. 1 and is adapted to output the foregoing output display data signal $S_{O1}$, the first switch unit T1 is adapted to determine, according to the first control signal CS1, whether to output the received input display data signal $S_I$ as the output display data signal $S_{O1}$. The second switch unit T2 has a first terminal, a control terminal, and a second terminal, the first terminal of the second switch unit T2 is electrically coupled to the first terminal of the first switch unit T1 and receives the input display data signal $S_I$, the control terminal of the second switch unit T2 is electrically coupled to a second control signal line 23 and receives a second control signal CS2, the second terminal of the second switch unit T2 is electrically coupled to one of the data lines DL in FIG. 1 and is adapted to output the foregoing output display data signal $S_{O2}$, the second switch unit T2 is adapted to determine, according to the second control signal CS2, whether to output the received input display data signal $S_I$ as the output display data signal $S_{O2}$, and the first switch unit T1 and the second switch unit T2 are coupled to different data lines DL.

The switching unit 21*b* includes a third switch unit T3 and a fourth switch unit T4, the third switch unit T3 has a first terminal, a control terminal, and a second terminal, the first terminal of the third switch unit T3 receives the input display data signal $S_I$, the control terminal of the third switch unit T3 is electrically coupled to the second control signal line 23 and receives the second control signal CS2, the second terminal of the third switch unit T3 is electrically coupled to one of the data lines DL in FIG. 1 and is adapted to output the foregoing output display data signal $S_{O3}$, the third switch unit T3 is adapted to determine, according to the second control signal CS2, whether to output the received input display data signal $S_I$ as the output display data signal $S_{O3}$, and the third switch unit T3, the first switch unit T1, and the second switch unit T2 are coupled to different data lines DL. The fourth switch unit T4 has a first terminal, a control terminal, and a second terminal, the first terminal of the fourth switch unit T4 is electrically coupled to the first terminal of the third switch unit T3 and receives the input display data signal $S_I$, the control terminal of the fourth switch unit T4 is electrically coupled to the first control signal line 22 and receives the first control signal CS1, the second terminal of the fourth switch unit T4 is electrically coupled to one of the data lines DL in FIG. 1 and is adapted to output the foregoing output display data signal $S_{O4}$, and the fourth switch unit T4, the first switch unit T1, the second switch unit T2, and the third switch unit T3 are coupled to different data lines DL.

Figure 2B:
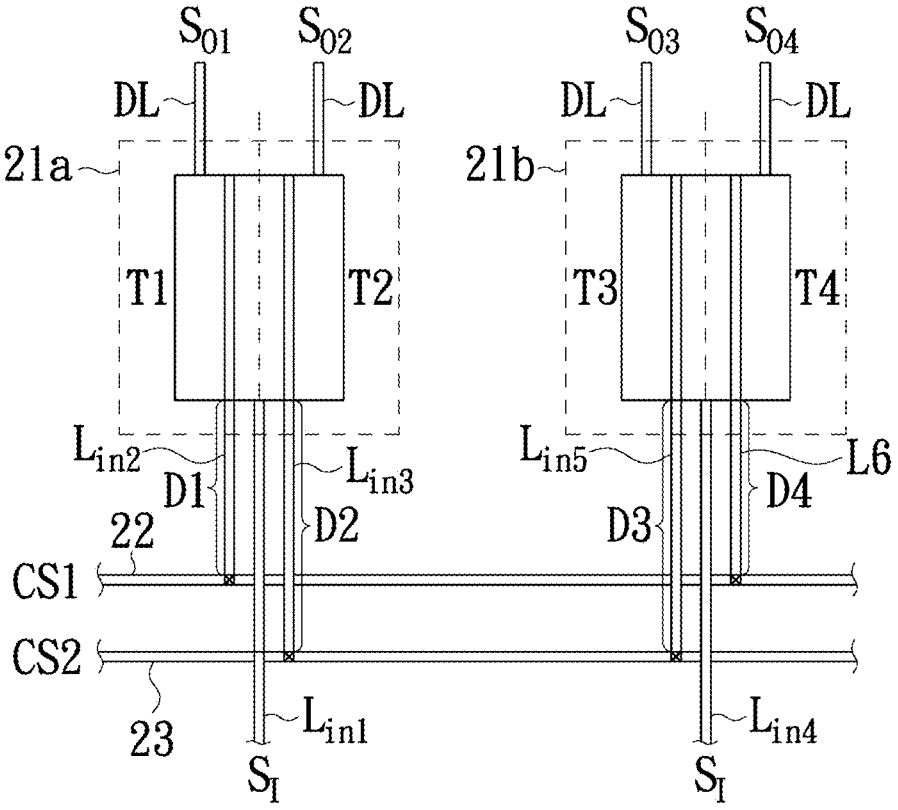
FIG. 2B is a schematic diagram of a first configuration embodiment of a first equivalent circuit embodiment of a multiplexer according to the present invention.

Then referring to FIG. 2B, FIG. 2B is a schematic diagram of a first configuration embodiment of a first equivalent circuit embodiment of a multiplexer 20. The multiplexer 20, a first control signal line 22, and a second control signal line 23 may be configured on a substrate of a display device 100, but the present invention is not limited thereto. In FIG. 2B, the aforementioned elements are not described again. In this embodiment, a first terminal of a first switch unit T1 and a first terminal of a second switch unit T2 receive an input display data signal $S_I$ by using a conductive line $L_{in1}$, the control terminal of the first switch unit T1 is electrically coupled to the first control signal line 22 by using a conductive line $L_{in2}$, and a control terminal of the second switch unit T2 is electrically coupled to the second control signal line 23 by using a conductive line $L_{in3}$. First terminals of a third switch unit T3 and a fourth switch unit T4 receive the input display data signal $S_I$ by using a conductive line $L_{in4}$, a control terminal of the third switch unit T3 is electrically coupled to the second control signal line 23 by using a conductive line $L_{in5}$, and a control terminal of the fourth switch unit T4 is electrically coupled to the first control signal line 22 by using a conductive line $L_{in6}$.

In this embodiment, configuration locations of the first switch unit T1, the second switch unit T2, the third switch unit T3, and the fourth switch unit T4 are in a same row, the second switch unit T2 is adjacent to the third switch unit T3 and the first switch unit T1 in a first direction, the third switch unit T3 is adjacent to the second switch unit T2 and the fourth switch unit T4 in the first direction, the first control signal line 22 and the second control signal line 23 extend in the first direction, the first control signal line 22 is adjacent to the second control signal line 23 in a second direction, the first control signal line 22 is more adjacent to the first switch unit T1, the second switch unit T2, the third switch unit T3, and the fourth switch unit T4 than the second control signal line 23, and the first direction and the second direction are perpendicular to each other. Moreover, the conductive line $L_{in2}$ has a first wiring length D1, and the first wiring length D1 is also a path distance of the conductive line $L_{in2}$ running from the control terminal of the first switch unit T1 to the first control signal line 22. The conductive line $L_{in3}$ has a second wiring length D2, and the second wiring length D2 is also a path distance of the conductive line $L_{in3}$ running from the control terminal of the second switch unit T2 to the second control signal line 23. The conductive line $L_{in5}$ has a third wiring length D3, and the third wiring length D3 is also a path distance of the conductive line $L_{in5}$ running from the control terminal of the third switch unit T3 to the second control signal line 23. The conductive line $L_{in6}$ has a fourth wiring length D4, and the fourth wiring length D4 is also a path distance of the conductive line $L_{in6}$ running from the control terminal of the fourth switch unit T4 to the first control signal line 22. Therefore, the first wiring length D1 of the conductive line $L_{in2}$ is less than the second wiring length D2 of the conductive line $L_{in3}$, the third wiring length D3 of the conductive line $L_{in5}$ is greater than the fourth wiring length D4 of the conductive line $L_{in6}$, and the second wiring length D2 and the third wiring length D3 are greater than the first wiring length D1 and the fourth wiring length D4.

Figure 2C:
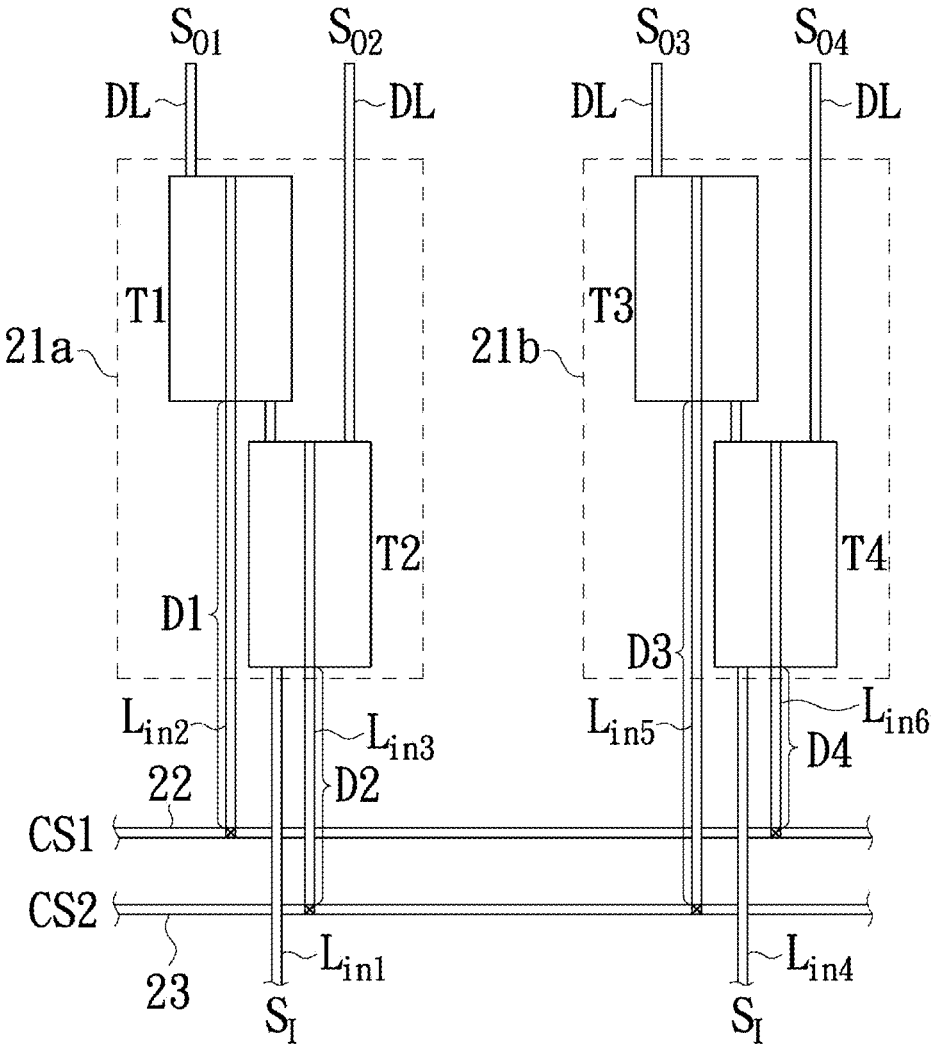
FIG. 2C is a schematic diagram of a second configuration embodiment of a first equivalent circuit embodiment of a multiplexer according to the present invention.

Referring to FIG. 2C, FIG. 2C is a schematic diagram of a second configuration embodiment of a first equivalent circuit embodiment of a multiplexer 20. In FIG. 2C, the aforementioned elements are not described again. In this embodiment, a first switch unit T1 and a third switch unit T3 are adjacent in a first direction and are configured in a first row, a second switch unit T2 and a fourth switch unit T4 are adjacent in the first direction and are configured in a second row, the first switch unit T1 and the second switch unit T2 are adjacent in a second direction, the third switch unit T3 and the fourth switch unit T4 are adjacent in the second direction, the first row and the second row are adjacent in the second direction, the first switch unit T1 and the third switch unit T3 are far away from a first control signal line 22 and a second control signal line 23, the second switch unit T2 and the fourth switch unit T4 are adjacent to the first control signal line 22 and the second control signal line 23, and the first control signal line 22 is more adjacent to the second switch unit T2 and the fourth switch unit T4 than the second control signal line 23, where the first direction and the second direction are perpendicular to each other. Therefore, in this embodiment, a third wiring length D3 of a conductive line $L_{in5}$ is greater than a first wiring length D1 of a conductive line $L_{in2}$, the first wiring length D1 of the conductive line $L_{in2}$ is greater than a second wiring length D2 of a conductive line $L_{in3}$, and the second wiring length D2 of the conductive line $L_{in3}$ is greater than a fourth wiring length D4 of a conductive line $L_{in6}$.

It may be summarized according to the embodiments of FIG. 2B and FIG. 2C that, configuration locations of switch units in each switching unit 21 are the same. As shown in FIG. 2B, the first switch unit T1 and the second switch unit T2 are horizontally adjacent to each other and the third switch unit T3 and the fourth switch unit T4 are horizontally adjacent to each other, or as shown in FIG. 2C, the first switch unit T1 and the second switch unit T2 are vertically adjacent to each other and the third switch unit T3 and the fourth switch unit T4 are vertically adjacent to each other. Moreover, switch units configured at a same configuration location in different switching units 21 receive different control signals CS. As shown in FIG. 2B and FIG. 2C, the first switch unit T1 and the third switch unit T3 at a same configuration location respectively receive the first control signal CS1 and the second control signal CS2, and the second switch unit T2 and the fourth switch unit T4 at a same configuration location respectively receive the second control signal CS2 and the first control signal CS1.

Figure 3A:
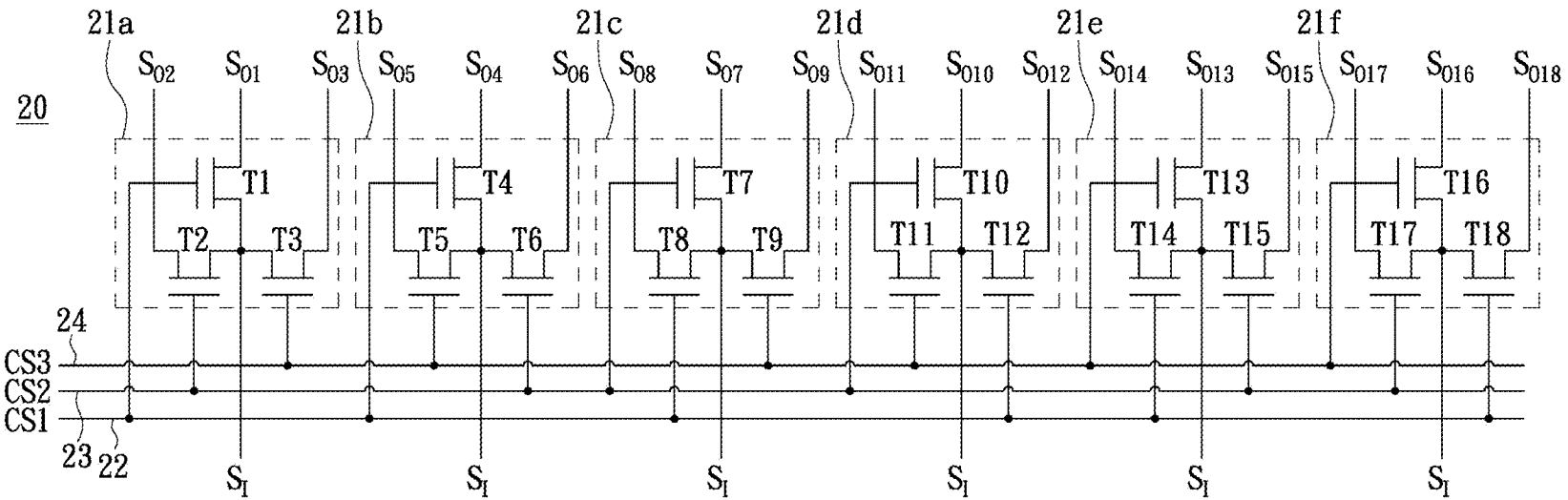
FIG. 3A is a schematic diagram of a second equivalent circuit embodiment of a multiplexer according to the present invention.

Referring to FIG. 3A, FIG. 3A is a schematic diagram of a second equivalent circuit embodiment of a multiplexer 20 according to the present invention. In this embodiment, an example in which the multiplexer 20 includes at least one first switching unit 21*a*, one second switching unit 21*b*, one third switching unit 21*c*, one fourth switching unit 21*d*, one fifth switching unit 21*e*, and one sixth switching unit 21*f* is used to perform description. The first switching unit 21*a* includes a first switch unit T1, a second switch unit T2, and a third switch unit T3, the first switch unit T1 has a first terminal, a control terminal, and a second terminal, the first terminal of the first switch unit T1 receives an input display data signal $S_I$, the control terminal of the first switch unit T1 is electrically coupled to a first control signal line 22 and receives a first control signal CS1, the second terminal of the first switch unit T1 is electrically coupled to one of the data lines DL in FIG. 1 and is adapted to output an output display data signal $S_{O1}$, and the first switch unit T1 is adapted to determine, according to the first control signal CS1, whether to output the received input display data signal $S_I$ as the output display data signal $S_{O1}$. The second switch unit T2 has a first terminal, a control terminal, and a second terminal, the first terminal of the second switch unit T2 is electrically coupled to the first terminal of the first switch unit T1 and receives the input display data signal $S_I$, the control terminal of the second switch unit T2 is electrically coupled to a second control signal line 23 and receives a second control signal CS2, the second terminal of the second switch unit T2 is electrically coupled to one of the data lines DL in FIG. 1 and is adapted to output an output display data signal $S_{O2}$, and the second switch unit T2 is adapted to determine, according to the second control signal CS2, whether to output the received input display data signal $S_I$ as the output display data signal $S_{O2}$. The third switch unit T3 has a first terminal, a control terminal, and a second terminal, the first terminal of the third switch unit T3 is electrically coupled to the first terminal of the first switch unit T1 and the first terminal of the second switch unit T2 and receives the input display data signal $S_I$, the control terminal of the third switch unit T3 is electrically coupled to a third control signal line 24 and receives a third control signal CS3, the second terminal of the third switch unit T3 is electrically coupled to one of the data lines DL in FIG. 1 and is adapted to output an output display data signal $S_{O3}$, and the third switch unit T3 is adapted to determine, according to the third control signal CS3, whether to output the received input display data signal $S_I$ as the output display data signal $S_{O3}$.

The second switching unit 21*b* includes a fourth switch unit T4, a fifth switch unit T5, and a sixth switch unit T6. The fourth switch unit T4 has a first terminal, a control terminal, and a second terminal, the first terminal of the fourth switch unit T4 receives the input display data signal $S_I$, the control terminal of the fourth switch unit T4 is electrically coupled to the first control signal line 22 and receives the first control signal CS1, the second terminal of the fourth switch unit T4 is electrically coupled to one of the data lines DL in FIG. 1 and is adapted to output an output display data signal $S_{O4}$, and the fourth switch unit T4 is adapted to determine, according to the first control signal CS1, whether to output the received input display data signal $S_I$ as the output display data signal $S_{O4}$. The fifth switch unit T5 has a first terminal, a control terminal, and a second terminal, the first terminal of the fifth switch unit T5 is electrically coupled to the first terminal of the fourth switch unit T4 and receives the input display data signal $S_I$, the control terminal of the fifth switch unit T5 is electrically coupled to the third control signal line 24 and receives the third control signal CS3, the second terminal of the fifth switch unit T5 is electrically coupled to one of the data lines DL in FIG. 1 and is adapted to output an output display data signal $S_{O5}$, and the fifth switch unit T5 is adapted to determine, according to the third control signal CS3, whether to output the received input display data signal $S_I$ as the output display data signal $S_{O5}$. The sixth switch unit T6 has a first terminal, a control terminal, and a second terminal, the first terminal of the sixth switch unit T6 is electrically coupled to the first terminal of the fourth switch unit T4 and the first terminal of the fifth switch unit T5 and receives the input display data signal $S_I$, the control terminal of the sixth switch unit T6 is electrically coupled to the second control signal line 23 and receives the second control signal CS2, the second terminal of the sixth switch unit T6 is electrically coupled to one of the data lines DL in FIG. 1 and is adapted to output an output display data signal $S_{O6}$, and the sixth switch unit T6 is adapted to determine, according to the second control signal CS2, whether to output the received input display data signal $S_I$ as the output display data signal $S_{O6}$.

The third switching unit 21*c* includes a seventh switch unit T7, an eighth switch unit T8, and a ninth switch unit T9. The seventh switch unit T7 has a first terminal, a control terminal, and a second terminal, the first terminal of the seventh switch unit T7 receives the input display data signal $S_I$, the control terminal of the seventh switch unit T7 is electrically coupled to the second control signal line 23 and receives the second control signal CS2, the second terminal of the seventh switch unit T7 is electrically coupled to one of the data lines DL in FIG. 1 and is adapted to output an output display data signal $S_{O7}$, and the seventh switch unit T7 is adapted to determine, according to the second control signal CS2, whether to output the received input display data signal $S_I$ as the output display data signal $S_{O7}$. The eighth switch unit T8 has a first terminal, a control terminal, and a second terminal, the first terminal of the eighth switch unit T8 is electrically coupled to the first terminal of the seventh switch unit T7 and receives the input display data signal $S_I$, the control terminal of the eighth switch unit T8 is electrically coupled to the first control signal line 22 and receives the first control signal CS1, the second terminal of the eighth switch unit T8 is electrically coupled to one of the data lines DL in FIG. 1 and is adapted to output an output display data signal $S_{O8}$, and the eighth switch unit T8 is adapted to determine, according to the first control signal CS1, whether to output the received input display data signal $S_I$ as the output display data signal $S_{O8}$. The ninth switch unit T9 has a first terminal, a control terminal, and a second terminal, the first terminal of the ninth switch unit T9 is electrically coupled to the first terminal of the seventh switch unit T7 and the first terminal of the eighth switch unit T8 and receives the input display data signal $S_I$, the control terminal of the ninth switch unit T9 is electrically coupled to the third control signal line 24 and receives the third control signal CS3, the second terminal of the ninth switch unit T9 is electrically coupled to one of the data lines DL in FIG. 1 and is adapted to output an output display data signal $S_{O9}$, and the ninth switch unit T9 is adapted to determine, according to the third control signal CS3, whether to output the received input display data signal $S_I$ as the output display data signal $S_{O9}$.

The fourth switching unit 21*d* includes a tenth switch unit T10, an eleventh switch unit T11, and a twelfth switch unit T12. The tenth switch unit T10 has a first terminal, a control terminal, and a second terminal, the first terminal of the tenth switch unit T10 receives the input display data signal $S_I$, the control terminal of the tenth switch unit T10 is electrically coupled to the second control signal line 23 and receives the second control signal CS2, the second terminal of the tenth switch unit is electrically coupled to one of the data lines DL in FIG. 1 and is adapted to output an output display data signal $S_{O10}$, and the tenth switch unit T10 is adapted to determine, according to the second control signal CS2, whether to output the received input display data signal $S_I$ as the output display data signal $S_{O10}$. The eleventh switch unit T11 has a first terminal, a control terminal, and a second terminal, the first terminal of the eleventh switch unit T11 is electrically coupled to the first terminal of the tenth switch unit T10 and receives the input display data signal $S_I$, the control terminal of the eleventh switch unit T11 is electrically coupled to the third control signal line 24 and receives the third control signal CS3, the second terminal of the eleventh switch unit T11 is electrically coupled to one of the data lines DL in FIG. 1 and is adapted to output an output display data signal $S_{O11}$, and the eleventh switch unit T11 is adapted to determine, according to the third control signal CS3, whether to output the received input display data signal $S_I$ as the output display data signal $S_{O11}$. The twelfth switch unit T12 has a first terminal, a control terminal, and a second terminal, the first terminal of the twelfth switch unit T12 is electrically coupled to the first terminal of the tenth switch unit T10 and the first terminal of the eleventh switch unit T11 and receives the input display data signal $S_I$, the control terminal of the twelfth switch unit T12 is electrically coupled to the first control signal line 22 and receives the first control signal CS1, the second terminal of the twelfth switch unit T12 is electrically coupled to one of the data lines DL in FIG. 1 and is adapted to output an output display data signal $S_{O12}$, and the twelfth switch unit T12 is adapted to determine, according to the first control signal CS1, whether to output the received input display data signal $S_I$ as the output display data signal $S_{O12}$.

The fifth switching unit 21*e* includes a thirteenth switch unit T13, a fourteenth switch unit T14, and a fifteenth switch unit T15. The thirteenth switch unit T13 has a first terminal, a control terminal, and a second terminal, the first terminal of the thirteenth switch unit T13 receives the input display data signal $S_I$, the control terminal of the thirteenth switch unit T13 is electrically coupled to the third control signal line 24 and receives the third control signal CS3, the second terminal of the thirteenth switch unit T13 is electrically coupled to one of the data lines DL in FIG. 1 and is adapted to output an output display data signal $S_{O13}$, the thirteenth switch unit T13 is adapted to determine, according to the third control signal CS3, whether to output the received input display data signal $S_I$ as the output display data signal $S_{O13}$. The fourteenth switch unit T14 has a first terminal, a control terminal, and a second terminal, the first terminal of the fourteenth switch unit T14 is electrically coupled to the first terminal of the thirteenth switch unit T13 and receives the input display data signal $S_I$, the control terminal of the fourteenth switch unit T14 is electrically coupled to the first control signal line 22 and receives the first control signal CS1, the second terminal of the fourteenth switch unit T14 is electrically coupled to one of the data lines DL in FIG. 1 and is adapted to output an output display data signal $S_{O14}$, and the fourteenth switch unit T14 is adapted to determine, according to the first control signal CS1, whether to output the received input display data signal $S_I$ as the output display data signal $S_{O14}$. The fifteenth switch unit T15 has a first terminal, a control terminal, and a second terminal, the first terminal of the fifteenth switch unit T15 is electrically coupled to the first terminal of the thirteenth switch unit T13 and the first terminal of the fourteenth switch unit T14 and receives the input display data signal $S_I$, the control terminal of the fifteenth switch unit T15 is electrically coupled to the second control signal line 23 and receives the second control signal CS2, the second terminal of the fifteenth switch unit T15 is electrically coupled to one of the data lines DL in FIG. 1 and is adapted to output an output display data signal $S_{O15}$, and the fifteenth switch unit T15 is adapted to determine, according to the second control signal CS2, whether to output the received input display data signal $S_I$ as the output display data signal $S_{O15}$.

The sixth switching unit 21*f* includes a sixteenth switch unit T16, a seventeenth switch unit T17, and an eighteenth switch unit T18. The sixteenth switch unit T16 has a first terminal, a control terminal, and a second terminal, the first terminal of the sixteenth switch unit T16 receives the input display data signal $S_I$, the control terminal of the sixteenth switch unit T16 is electrically coupled to the third control signal line 24 and receives the third control signal CS3, the second terminal of the sixteenth switch unit T16 is electrically coupled to one of the data lines DL in FIG. 1 and is adapted to output an output display data signal $S_{O16}$, and the sixteenth switch unit T16 is adapted to determine, according to the third control signal CS3, whether to output the received input display data signal $S_I$ as the output display data signal $S_{O16}$. The seventeenth switch unit T17 has a first terminal, a control terminal, and a second terminal, the first terminal of the seventeenth switch unit T17 is electrically coupled to the first terminal of the sixteenth switch unit T16 and receives the input display data signal $S_I$, the control terminal of the seventeenth switch unit T17 is electrically coupled to the second control signal line 23 and receives the second control signal CS2, the second terminal of the seventeenth switch unit T17 is electrically coupled to one of the data lines DL in FIG. 1 and is adapted to output an output display data signal $S_{O17}$, and the seventeenth switch unit T17 is adapted to determine, according to the second control signal CS2, whether to output the received input display data signal $S_I$ as the output display data signal $S_{O17}$. The eighteenth switch unit T18 has a first terminal, a control terminal, and a second terminal, the first terminal of the eighteenth switch unit T18 is electrically coupled to the first terminal of the sixteenth switch unit T16 and the first terminal of the seventeenth switch unit T17 and receives the input display data signal $S_I$, the control terminal of the eighteenth switch unit T18 is electrically coupled to the first control signal line 22 and receives the first control signal CS1, the second terminal of the eighteenth switch unit T18 is electrically coupled to one of the data lines DL in FIG. 1 and is adapted to output an output display data signal $S_{O18}$, and the eighteenth switch unit T18 is adapted to determine, according to the first control signal CS1, whether to output the received input display data signal $S_I$ as the output display data signal $S_{O18}$.

Figure 3B:
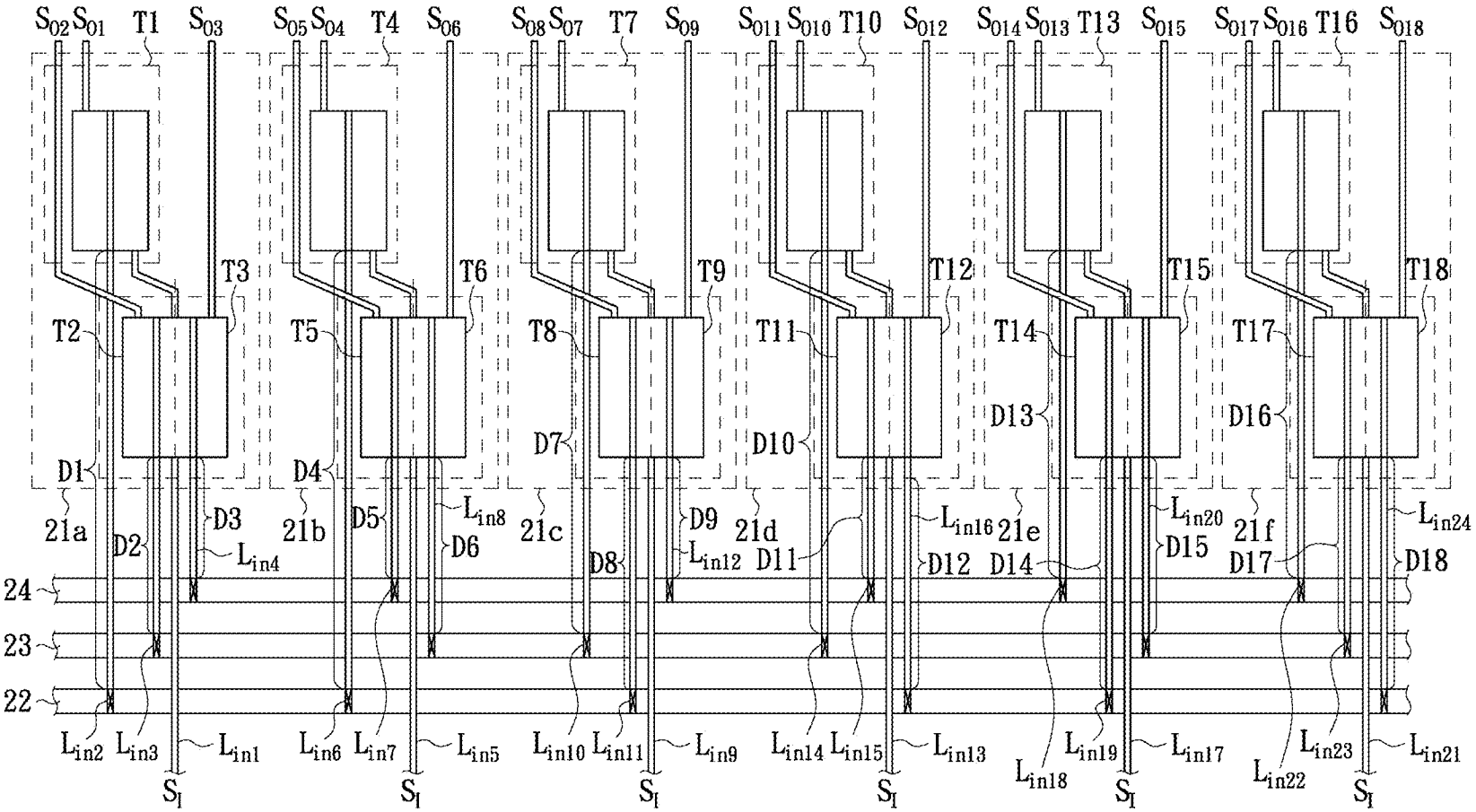
FIG. 3B is a schematic diagram of a first configuration embodiment of a second equivalent circuit embodiment of a multiplexer according to the present invention.

Then referring to FIG. 3B, FIG. 3B is a schematic diagram of a first configuration embodiment of a second equivalent circuit embodiment of a multiplexer 20. In FIG. 3B, the aforementioned elements are not described again. In this embodiment, a first terminal of a first switch unit T1, a first terminal of a second switch unit T2, and a first terminal of a third switch unit T3 receive an input display data signal $S_I$ by using a conductive line $L_{in1}$. A control terminal of the first switch unit T1 is electrically coupled to a first control signal line 22 by using a conductive line $L_{in2}$, the conductive line $L_{in2}$ has a first wiring length D1, and the first wiring length D1 is also a path distance of the conductive line $L_{in2}$ running from the control terminal of the first switch unit T1 to the first control signal line 22. A control terminal of the second switch unit T2 is electrically coupled to a second control signal line 23 by using a conductive line $L_{in3}$, the conductive line $L_{in3}$ has a second wiring length D2, and the second wiring length D2 is also a path distance of the conductive line $L_{in3}$ running from the control terminal of the second switch unit T2 to the second control signal line 23. A control terminal of the third switch unit T3 is electrically coupled to the third control signal line 24 by using a conductive line $L_{in4}$, the conductive line $L_{in4}$ has a third wiring length D3, and the third wiring length D3 is also a path distance of the conductive line $L_{in4}$ running from the control terminal of the third switch unit T3 to the third control signal line 24.

A first terminal of a fourth switch unit T4, a first terminal of a fifth switch unit T5, and a first terminal of a sixth switch unit T6 receive the input display data signal $S_I$ by using a conductive line $L_{in5}$, a control terminal of the fourth switch unit T4 is electrically coupled to the first control signal line 22 by using a conductive line $L_{in6}$, the conductive line $L_{in6}$ has a fourth wiring length D4, and the fourth wiring length D4 is also a path distance of the conductive line $L_{in6}$ running from the control terminal of the fourth switch unit T4 to the first control signal line 22. A control terminal of the fifth switch unit T5 is electrically coupled to the third control signal line 24 by using a conductive line $L_{in7}$, the conductive line $L_{in7}$ has a fifth wiring length D5, and the fifth wiring length D5 is also a path distance of the conductive line $L_{in7}$ running from the control terminal of the fifth switch unit T5 to the third control signal line 24. A control terminal of the sixth switch unit T6 is electrically coupled to the second control signal line 23 by using a conductive line $L_{in8}$, the conductive line $L_{in8}$ has a sixth wiring length D6, and the sixth wiring length D6 is also a path distance of the conductive line $L_{in8}$ running from the control terminal of the sixth switch unit T6 to the second control signal line 23.

A first terminal of a seventh switch unit T7, a first terminal of an eighth switch unit T8, and a first terminal of a ninth switch unit T9 receive the input display data signal $S_I$ by using a conductive line $L_{in9}$, a control terminal of the seventh switch unit T7 is electrically coupled to the second control signal line 23 by using a conductive line $L_{in10}$, the conductive line $L_{in10}$ has a seventh wiring length D7, and the seventh wiring length D7 is also a path distance of the conductive line $L_{in10}$ running from the control terminal of the seventh switch unit T7 to the second control signal line 23. A control terminal of the eighth switch unit T8 is electrically coupled to the first control signal line 22 by using a conductive line $L_{in11}$, the conductive line $L_{in11}$ has an eighth wiring length D8, and the eighth wiring length D8 is also a path distance of the conductive line $L_{in11}$ running from the control terminal of the eighth switch unit T8 to the first control signal line 22. A control terminal of the ninth switch unit T9 is electrically coupled to the third control signal line 24 by using a conductive line $L_{in12}$, the conductive line $L_{in12}$ has a ninth wiring length D9, and the ninth wiring length D9 is also a path distance of the conductive line $L_{in12}$ running from the control terminal of the ninth switch unit T9 to the third control signal line 24.

A first terminal of a tenth switch unit T10, a first terminal of an eleventh switch unit T11, and a first terminal of the twelfth switch unit T12 receive the input display data signal $S_I$ by using a conductive line $L_{in13}$, a control terminal of the tenth switch unit T10 is electrically coupled to the second control signal line 23 by using a conductive line $L_{in14}$, the conductive line $L_{in14}$ has a tenth wiring length D10, and the tenth wiring length D10 is also a path distance of the conductive line $L_{in14}$ running from the control terminal of the tenth switch unit T10 to the second control signal line 23. A control terminal of the eleventh switch unit T11 is electrically coupled to the third control signal line 24 by using a conductive line $L_{in15}$, the conductive line $L_{in15}$ has an eleventh wiring length D11, and the eleventh wiring length D11 is also a path distance of the conductive line $L_{in15}$ running from the control terminal of the eleventh switch unit T11 to the third control signal line 24. A control terminal of the twelfth switch unit T12 is electrically coupled to the first control signal line 22 by using a conductive line $L_{in16}$, the conductive line $L_{in16}$ has a twelfth wiring length D12, and the twelfth wiring length D12 is also a path distance of the conductive line $L_{in16}$ running from the control terminal of the twelfth switch unit T12 to the first control signal line 22.

A first terminal of a thirteenth switch unit T13, a first terminal of a fourteenth switch unit T14, and a first terminal of a fifteenth switch unit T15 receive the input display data signal $S_I$ by using a conductive line $L_{in17}$, a control terminal of the thirteenth switch unit T13 is electrically coupled to the third control signal line 24 by using a conductive line $L_{in18}$, the conductive line $L_{in18}$ has a thirteenth wiring length D13, and the thirteenth wiring length D13 is also a path distance of the conductive line $L_{in18}$ running from the control terminal of the thirteenth switch unit T13 to the third control signal line 24. A control terminal of the fourteenth switch unit T14 is electrically coupled to the first control signal line 22 by using a conductive line $L_{in19}$, the conductive line $L_{in19}$ has a fourteenth wiring length D14, and the fourteenth wiring length D14 is also a path distance of the conductive line $L_{in19}$ running from the control terminal of the fourteenth switch unit T14 to the first control signal line 22. A control terminal of the fifteenth switch unit T15 is electrically coupled to the second control signal line 23 by using a conductive line $L_{in20}$, the conductive line $L_{in20}$ has a fifteenth wiring length D15, and the fifteenth wiring length D15 is also a path distance of the conductive line $L_{in20}$ running from the control terminal of the fifteenth switch unit T15 to the second control signal line 23.

A first terminal of a sixteenth switch unit T16, a first terminal of a seventeenth switch unit T17, and a first terminal of an eighteenth switch unit T18 receive the input display data signal $S_I$ by using a conductive line $L_{in21}$, a control terminal of the sixteenth switch unit T16 is electrically coupled to the third control signal line 24 by using a conductive line $L_{in22}$, the conductive line $L_{in22}$ has a sixteenth wiring length D16, and the sixteenth wiring length D16 is also a path distance of the conductive line $L_{in22}$ running from the control terminal of the sixteenth switch unit T16 to the third control signal line 24. A control terminal of the seventeenth switch unit T17 is electrically coupled to the second control signal line 23 by using a conductive line $L_{in23}$, the conductive line $L_{in23}$ has a seventeenth wiring length D17, and the seventeenth wiring length D17 is also a path distance of the conductive line $L_{in23}$ running from the control terminal of the seventeenth switch unit T17 to the second control signal line 23. A control terminal of the eighteenth switch unit T18 is electrically coupled to the first control signal line 22 by using a conductive line $L_{in24}$, the conductive line $L_{in24}$ has an eighteenth wiring length D18, and the eighteenth wiring length D18 is also a path distance of the conductive line $L_{in24}$ running from the control terminal of the eighteenth switch unit T18 to the first control signal line 22.

In this embodiment, the first switch unit T1, the fourth switch unit T4, the seventh switch unit T7, the tenth switch unit T10, the thirteenth switch unit T13, and the sixteenth switch unit T16 are sequentially configured in a first row and are adjacent to each other in a first direction, the second switch unit T2, the third switch unit T3, the fifth switch unit T5, the sixth switch unit T6, the eighth switch unit T8, the ninth switch unit T9, the eleventh switch unit T11, the twelfth switch unit T12, the fourteenth switch unit T14, the fifteenth switch unit T15, the seventeenth switch unit T17, and the eighteenth switch unit T18 are sequentially configured in a second row and are adjacent to each other in the first direction, and the first row and the second row are adjacent in the second direction. The first switch unit T1 is adjacent to the second switch unit T2 and the third switch unit T3 in the second direction, the fourth switch unit T4 is adjacent to the fifth switch unit T5 and the sixth switch unit T6 in the second direction, the seventh switch unit T7 is adjacent to the eighth switch unit T8 and the ninth switch unit T9 in the second direction, the tenth switch unit T10 is adjacent to the eleventh switch unit T11 and the twelfth switch unit T12 in the second direction, the thirteenth switch unit T13 is adjacent to the fourteenth switch unit T14 and the fifteenth switch unit T15 in the second direction, and the sixteenth switch unit T16 is adjacent to the seventeenth switch unit T17 and the eighteenth switch unit T18 in the second direction. The first row is farther away from the first control signal line 22, the second control signal line 23, and the third control signal line 24 than the second row, the first control signal line 22, the second control signal line 23, and the third control signal line 24 extend in the first direction, the first control signal line 22, the second control signal line 23, and the third control signal line 24 are adjacent in the second direction, the third control signal line 24 is more adjacent to the second row than the first control signal line 22 and the second control signal line 23, and the first control signal line 22 is farther away from the second row than the second control signal line 23 and the third control signal line 24, where the first direction and the second direction are perpendicular to each other.

Therefore, in the embodiment of FIG. 3B, the first wiring length D1 of the conductive line $L_{in2}$ and the fourth wiring length D4 of the conductive line $L_{in6}$ are greater than the seventh wiring length D7 of the conductive line $L_{in10}$ and the tenth wiring length D10 of the conductive line $L_{in14}$. The seventh wiring length D7 of the conductive line $L_{in10}$ and the tenth wiring length D10 of the conductive line $L_{in14}$ are greater than the thirteenth wiring length D13 of the conductive line $L_{in18}$ and the sixteenth wiring length D16 of the conductive line $L_{in22}$. The thirteenth wiring length D13 of the conductive line $L_{in18}$ and the sixteenth wiring length D16 of the conductive line $L_{in22}$ are greater than the eighth wiring length D8 of the conductive line $L_{in11}$, the twelfth wiring length D12 of the conductive line $L_{in16}$, the fourteenth wiring length D14 of the conductive line $L_{in19}$, and the eighteenth wiring length D18 of the conductive line $L_{in24}$. The eighth wiring length D8 of the conductive line $L_{in11}$, the twelfth wiring length D12 of the conductive line $L_{in16}$, the fourteenth wiring length D14 of the conductive line $L_{in19}$, and the eighteenth wiring length D18 of the conductive line $L_{in24}$ are greater than the second wiring length D2 of the conductive line $L_{in3}$, the sixth wiring length D6 of the conductive line $L_{in8}$, the fifteenth wiring length D15 of the conductive line $L_{in20}$, and the seventeenth wiring length D17 of the conductive line $L_{in23}$. The second wiring length D2 of the conductive line $L_{in3}$, the sixth wiring length D6 of the conductive line $L_{in8}$, the fifteenth wiring length D15 of the conductive line $L_{in20}$, and the seventeenth wiring length D17 of the conductive line $L_{in23}$ are greater than the third wiring length D3 of the conductive line $L_{in4}$, the fifth wiring length D5 of the conductive line $L_{in7}$, the ninth wiring length D9 of the conductive line $L_{in12}$, and the eleventh wiring length D11 of the conductive line $L_{in15}$.

Figure 3C:
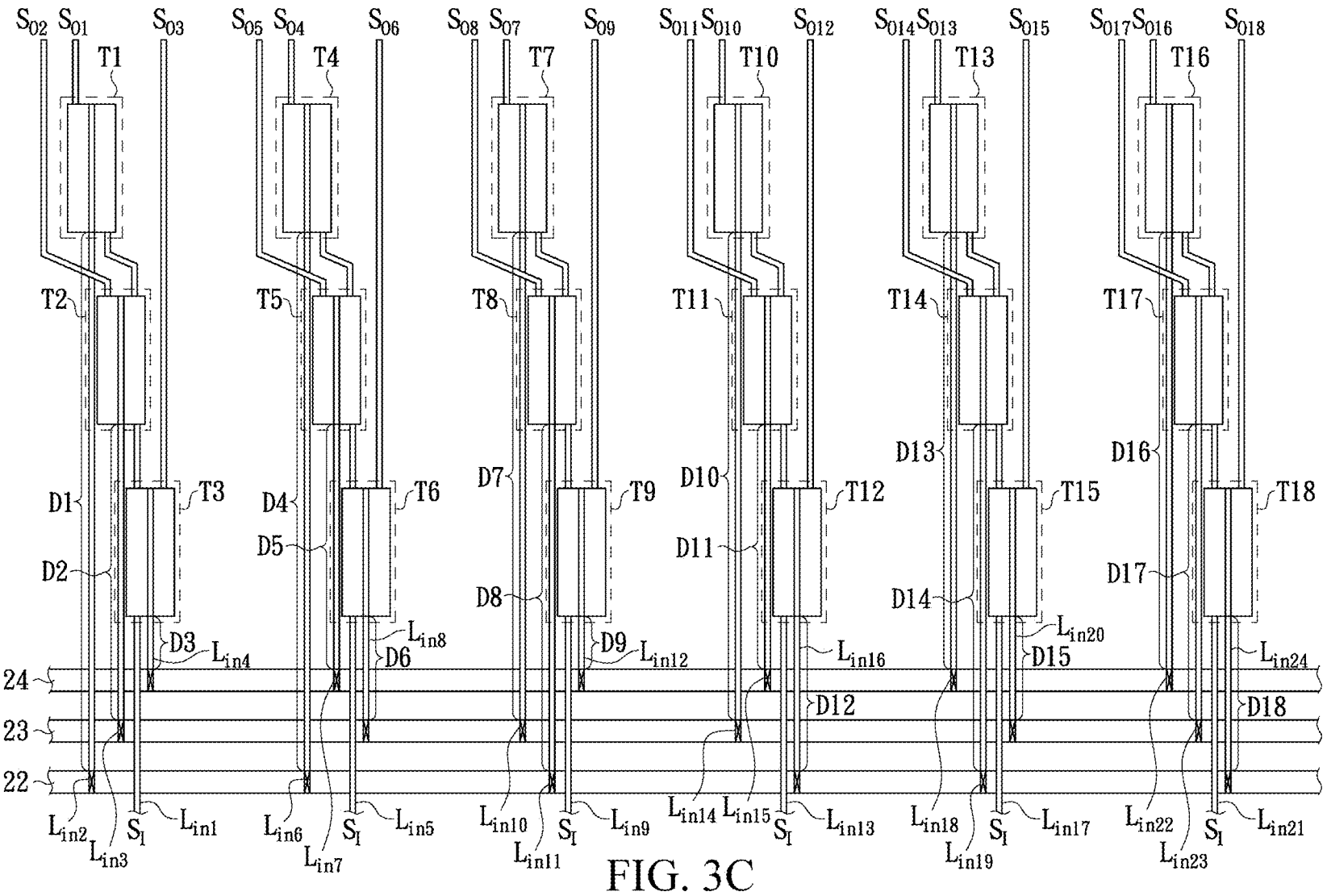
FIG. 3C is a schematic diagram of a second configuration embodiment of a second equivalent circuit embodiment of a multiplexer according to the present invention.

Referring to FIG. 3C, FIG. 3C is a schematic diagram of a second configuration embodiment of a second equivalent circuit embodiment of a multiplexer 20. The embodiment of FIG. 3C is applicable to a high-resolution display device 100, but the present invention is not limited thereto. In FIG. 3C, the aforementioned elements are not described again. In this embodiment, a first switch unit T1, a fourth switch unit T4, a seventh switch unit T7, a tenth switch unit T10, a thirteenth switch unit T13, and a sixteenth switch unit T16 are sequentially configured in a first row and are adjacent to each other in a first direction. A second switch unit T2, a fifth switch unit T5, an eighth switch unit T8, an eleventh switch unit T11, a fourteenth switch unit T14, and a seventeenth switch unit T17 are sequentially configured in a second row and are adjacent to each other in the first direction. A third switch unit T3, a sixth switch unit T6, a ninth switch unit T9, a twelfth switch unit T12, a fifteenth switch unit T15, and an eighteenth switch unit T18 are sequentially configured in a third row and are adjacent to each other in the first direction. Moreover, the first switch unit T1, the second switch unit T2, and the third switch unit T3 are sequentially arranged in a second direction and are adjacent to each other, the fourth switch unit T4, the fifth switch unit T5, and the sixth switch unit T6 are sequentially arranged in the second direction and are adjacent to each other, the seventh switch unit T7, the eighth switch unit T8, and the ninth switch unit T9 are sequentially arranged in the second direction and are adjacent to each other, the tenth switch unit T10, the eleventh switch unit T11, and the twelfth switch unit T12 are sequentially arranged in the second direction and are adjacent to each other, the thirteenth switch unit T13, the fourteenth switch unit T14, and the fifteenth switch unit T15 are sequentially arranged in the second direction and are adjacent to each other, and the sixteenth switch unit T16, the seventeenth switch unit T17, and the eighteenth switch unit T18 are sequentially arranged in the second direction and are adjacent to each other. The first row, the second row, and the third row are sequentially arranged in the second direction, the first row is farther away from a first control signal line 22, a second control signal line 23, and a third control signal line 24 than the second row and the third row, the third row is more adjacent to the first control signal line 22, the second control signal line 23, and the third control signal line 24 than the first row and the second row, the third control signal line 24 is more adjacent to the third row than the first control signal line 22 and the second control signal line 23, and the first control signal line 22 is farther away from the third row than the second control signal line 23 and the third control signal line 24. In this embodiment, the first direction and the second direction are perpendicular to each other.

Therefore, in the embodiment of FIG. 3C, a first wiring length D1 of a conductive line $L_{in2}$ and a fourth wiring length D4 of a conductive line $L_{in6}$ are greater than a seventh wiring length D7 of a conductive line $L_{in10}$ and a tenth wiring length D10 of a conductive line $L_{in14}$, the seventh wiring length D7 of the conductive line $L_{in10}$ and the tenth wiring length D10 of the conductive line $L_{in14}$ are greater than a thirteenth wiring length D13 of a conductive line $L_{in18}$ and a sixteenth wiring length D16 of a conductive line $L_{in22}$, the thirteenth wiring length D13 of the conductive line $L_{in18}$ and the sixteenth wiring length D16 of the conductive line $L_{in22}$ are greater than an eighth wiring length D8 of a conductive line $L_{in11}$ and a seventeenth wiring length D17 of a conductive line $L_{in23}$, the eighth wiring length D8 of the conductive line $L_{in11}$ and the seventeenth wiring length D17 of the conductive line $L_{in23}$ are greater than a second wiring length D2 of a conductive line $L_{in3}$ and a fourteenth wiring length D14 of a conductive line $L_{in19}$, the second wiring length D2 of the conductive line $L_{in3}$ and the fourteenth wiring length D14 of the conductive line $L_{in19}$ are greater than a fifth wiring length D5 of a conductive line $L_{in7}$ and an eleventh wiring length D11 of a conductive line $L_{in15}$, the fifth wiring length D5 of the conductive line $L_{in7}$ and the eleventh wiring length D11 of the conductive line $L_{in15}$ are greater than a twelfth wiring length D12 of a conductive line $L_{in16}$ and an eighteenth wiring length D18 of a conductive line $L_{in24}$, the twelfth wiring length D12 of the conductive line $L_{in16}$ and the eighteenth wiring length D18 of the conductive line $L_{in24}$ are greater than a sixth wiring length D6 of a conductive line $L_{in8}$ and a fifteenth wiring length D15 of a conductive line $L_{in20}$, and the sixth wiring length D6 of the conductive line $L_{in8}$ and the fifteenth wiring length D15 of the conductive line $L_{in20}$ are greater than a third wiring length D3 of a conductive line $L_{in4}$ and a ninth wiring length D9 of a conductive line $L_{in12}$.

Therefore, it may be summarized according to the embodiments of FIG. 3B and FIG. 3C that, configuration locations of switch units in each switching unit 21 are the same. As shown in FIG. 3B, each switching unit includes one switch unit configured in the first row (the first switch unit T1, the fourth switch unit T4, the seventh switch unit T7, the tenth switch unit T10, the thirteenth switch unit T13, or the sixteenth switch unit T16) and two switch units configured in the second row (the second switch unit and the third switch unit, the fifth switch unit and the sixth switch unit, the eighth switch unit and the ninth switch unit, the eleventh switch unit and the twelfth switch unit, the fourteenth switch unit and the fifteenth switch unit, or the seventeenth switch unit and the eighteenth switch unit). In FIG. 3C, each switching unit 21 includes one switch unit configured in the first row (the first switch unit T1, the fourth switch unit T4, the seventh switch unit T7, the tenth switch unit T10, the thirteenth switch unit T13, or the sixteenth switch unit T16), one switch unit configured in the second row (the second switch unit T2, the fifth switch unit T5, the eighth switch unit T8, the eleventh switch unit T11, the fourteenth switch unit T14, or the seventeenth switch unit T17), and one switch unit configured in the third row (the third switch unit T3, the sixth switch unit T6, the ninth switch unit T9, the twelfth switch unit T12, the fifteenth switch unit T15, or the eighteenth switch unit T18).

Moreover, some of switch units configured at a same configuration location in different switching units 21 receive different control signals CS. As shown in FIG. 3B and FIG. 3C, for those configured at a same configuration location in different switching units 21, the first switch unit T1 and the fourth switch unit T4 receive the same first control signal CS, the seventh switch unit T7 and the tenth switch unit T10 receive the same second control signal CS2, the thirteenth switch unit T13 and the sixteenth switch unit T16 receive the same third control signal CS, the first switch unit T1 as well as the fourth switch unit T4, and the seventh switch unit T7, the tenth switch unit T10, the thirteenth switch unit T13 as well as the sixteenth switch unit T16 receive different control signals CS, the seventh switch unit T7 as well as the tenth switch unit T10, and the first switch unit T1, the fourth switch unit T4, the thirteenth switch unit T13 as well as the sixteenth switch unit T16 receive different control signals CS, and the thirteenth switch unit T13 as well as the sixteenth switch unit T16, and the first switch unit T1, the fourth switch unit T4, the seventh switch unit T7 as well as the tenth switch unit T10 receive different control signals CS.

For those configured at a same configuration location in different switching units 21, the second switch unit T2 and the seventeenth switch unit T17 receive the same second control signal CS2, the fifth switch unit T5 and the eleventh switch unit T11 receive the same third control signal CS3, the eighth switch unit T8 and the fourteenth switch unit T14 receive the same first control signal CS1, the second switch unit T2 as well as the seventeenth switch unit T17, and the fifth switch unit T5, the eleventh switch unit T11, the eighth switch unit T8 as well as the fourteenth switch unit T14 receive different control signals CS, the fifth switch unit T5 as well as the eleventh switch unit T11, and the second switch unit T2, the seventeenth switch unit T17, the eighth switch unit T8 as well as the fourteenth switch unit T14 receive different control signals CS, and the eighth switch unit T8 as well as the fourteenth switch unit T14, and the second switch unit T2, the seventeenth switch unit, the fifth switch unit T5 as well as the eleventh switch unit T11 receive different control signals CS.

For those configured at a same configuration location in different switching units 21, the third switch unit T3 and the ninth switch unit T9 receive the same third control signal CS3, the sixth switch unit T6 and the fifteenth switch unit T15 receive the same second control signal CS2, and the twelfth switch unit T12 and the eighteenth switch unit T18 receive the same first control signal CS1. The third switch unit T3 as well as the ninth switch unit T9, and the sixth switch unit T6, the fifteenth switch unit T15, the twelfth switch unit T12 as well as the eighteenth switch unit T18 receive different control signals CS, the sixth switch unit T6 as well as the fifteenth switch unit T15, and the third switch unit T3, the ninth switch unit T9, the twelfth switch unit T12 as well as the eighteenth switch unit T18 receive different control signals CS, and the twelfth switch unit T12 as well as the eighteenth switch unit T18, and the third switch unit T3, the ninth switch unit T9, the sixth switch unit T6 as well as the fifteenth switch unit T15 receive different control signals CS.

A quantity of switch units T included in the foregoing switching unit 21 may be adjusted according to requirements. In some embodiments, each switching unit 21 includes three switch units T; in some embodiments, each switching unit 21 may further include six switch units T, and the quantity of the switch units included in the switching unit is not limited in the present invention.

According to the foregoing embodiments, some of switch units configured at a same configuration location in different switching units are electrically coupled to different control signal lines and control signals. Therefore, wiring lengths of switch units receiving a same control signal may be different according to configuration locations of the switch units. Therefore, by means of configuration of switch units of the present invention, a total wiring length of a plurality of switch units may averagely correspond to a plurality of control signals, that is, each control signal corresponds to an approximately equal wiring length. Therefore, the present invention may avoid a case in which a conductive line electrically coupled to a particular control signal line generates a relatively large parasitic capacitance value when a wiring length corresponding to a particular control signal is obviously greater than that of another control signal. By means of this practice, the present invention effectively reduces and balances a parasitic capacitance value generated by a conductive line, and then reduces a noise of a display panel. In application of the display panel having a touch function, the reduction in the noise of the display panel may more effectively improve accuracy of touch sensing.

Although the present disclosure has been described by using the foregoing implementations, is the implementations are not used to limit the present invention. A person skilled in the art can make various modifications and improvements without departing from the spirit and scope of the present disclosure. Therefore, the protection scope of the present disclosure should be subject to the scope defined by the appended claims.

What is claimed is:

1. A multiplexer applied to a display device, comprising:

a plurality of switching units, electrically coupled to a data driver and a plurality of pixel units, wherein the switching units are adapted to receive a plurality of input display data signals output by the data driver, and the switching units output a plurality of output display data signals to the electrically coupled pixel units, wherein each respective switching unit of the switching units defines a plurality of configuration locations within the respective switching unit and comprises a plurality of switch units one-to-one configured at the configuration locations within the respective switching unit, the configuration locations of the switch units within each of the switching units are different from one another, the configuration locations of the switch units defined in each of the switching units are the same, and at least two of the switch units configured at a same configuration location in different switching units of the plurality of switching units receive different control signals.

2. The multiplexer according to claim 1, comprising:

a first switching unit, comprising:

a first switch unit, having a first terminal, a control terminal, and a second terminal, wherein the first terminal of the first switch unit receives the input display data signals, the control terminal of the first switch unit is electrically coupled to a first control signal line and receives a first control signal, and the second terminal of the first switch unit outputs the output display data signals; and a second switch unit, having a first terminal, a control terminal, and a second terminal, wherein the first terminal of the second switch unit is electrically coupled to the first terminal of the first switch unit, the control terminal of the second switch unit is electrically coupled to a second control signal line and receives a second control signal, and the second terminal of the second switch unit outputs the output display data signals; and a second switching unit, comprising:

a third switch unit, having a first terminal, a control terminal, and a second terminal, wherein the third terminal of the third switch unit receives the input display data signals, the control terminal of the third switch unit is electrically coupled to the second control signal line and receives the second control signal, and the second terminal of the third switch unit outputs the output display data signals; and a fourth switch unit, having a first terminal, a control terminal, and a second terminal, wherein the first terminal of the fourth switch unit is electrically coupled to the first terminal of the third switch unit, the control terminal of the fourth switch unit is electrically coupled to the first control signal line and receives the first control signal, and the second terminal of the fourth switch unit outputs the output display data signals.

3. The multiplexer according to claim 2, wherein configuration locations of the first switch unit, the second switch unit, the third switch unit, and the fourth switch unit are in a same row, the second switch unit is adjacent to the third switch unit and the first switch unit in a first direction, the third switch unit is adjacent to the fourth switch unit and the second switch unit in the first direction, and the first control signal line is more adjacent to the first switch unit, the second switch unit, the third switch unit, and the fourth switch unit than the second control signal line.

4. The multiplexer according to claim 2, wherein the first switch unit and the third switch unit are adjacent in a first direction and are configured in a first row, the second switch unit and the fourth switch unit are adjacent in the first direction and configured in a second row, the first switch unit and the second switch unit are adjacent in a second direction, the third switch unit and the fourth switch unit are adjacent in the second direction, the first row is adjacent to the second row in the second direction, the first switch unit and the third switch unit are far away from the first control signal line and the second control signal line, the second switch unit and the fourth switch unit are adjacent to the first control signal line and the second control signal line, and the first control signal line is more adjacent to the second switch unit and the fourth switch unit than the second control signal line, wherein the first direction and the second direction are perpendicular to each other.

5. The multiplexer according to claim 1, comprising:

a first switching unit, comprising:

a first switch unit, having a first terminal, a control terminal, and a second terminal, wherein the first terminal of the first switch unit receives the input display data signals, the control terminal of the first switch unit is electrically coupled to a first control signal line and receives a first control signal, and the second terminal of the first switch unit is adapted to output the output display data signals;

a second switch unit, having a first terminal, a control terminal, and a second terminal, wherein the first terminal of the second switch unit is electrically coupled to the first terminal of the first switch unit, the control terminal of the second switch unit is electrically coupled to a second control signal line and receives a second control signal, and the second terminal of the second switch unit is adapted to output the output display data signals; and a third switch unit, having a first terminal, a control terminal, and a second terminal, wherein the first terminal of the third switch unit is electrically coupled to the first terminal of the first switch unit and the first terminal of the second switch unit, the control terminal of the third switch unit is electrically coupled to a third control signal line and receives a third control signal, and the second terminal of the third switch unit is adapted to output the output display data signals;

a second switching unit, comprising:

a fourth switch unit, having a first terminal, a control terminal, and a second terminal, wherein the first terminal of the fourth switch unit receives the input display data signals, the control terminal of the fourth switch unit is electrically coupled to the first control signal line and receives the first control signal, and the second terminal of the fourth switch unit is adapted to output the output display data signals;

a fifth switch unit, having a first terminal, a control terminal, and a second terminal, wherein the first terminal of the fifth switch unit is electrically coupled to the first terminal of the fourth switch unit, the control terminal of the fifth switch unit is electrically coupled to the third control signal line and receives the third control signal, and the second terminal of the fifth switch unit is adapted to output the output display data signals; and a sixth switch unit, having a first terminal, a control terminal, and a second terminal, wherein the first terminal of the sixth switch unit is electrically coupled to the first terminal of the fourth switch unit and the first terminal of the fifth switch unit, the control terminal of the sixth switch unit is electrically coupled to the second control signal line and receives the second control signal, and the second terminal of the sixth switch unit is adapted to output the output display data signals;

a third switching unit, comprising:

a seventh switch unit, having a first terminal, a control terminal, and a second terminal, wherein the first terminal of the seventh switch unit receives the input display data signals, the control terminal of the seventh switch unit is electrically coupled to the second control signal line and receives the second control signal, and the second terminal of the seventh switch unit is adapted to output the output display data signals;

an eighth switch unit, having a first terminal, a control terminal, and a second terminal, wherein the first terminal of the eighth switch unit is electrically coupled to the first terminal of the seventh switch unit, the control terminal of the eighth switch unit is electrically coupled to the first control signal line and receives the first control signal, and the second terminal of the eighth switch unit is adapted to output the output display data signals; and a ninth switch unit, having a first terminal, a control terminal, and a second terminal, wherein the first terminal of the ninth switch unit is electrically coupled to the first terminal of the seventh switch unit and the first terminal of the eighth switch unit, the control terminal of the ninth switch unit is electrically coupled to the third control signal line and receives the third control signal, and the second terminal of the ninth switch unit is adapted to output the output display data signals;

a fourth switching unit, comprising:

a tenth switch unit, having a first terminal, a control terminal, and a second terminal, wherein the first terminal of the tenth switch unit receives the input display data signals, the control terminal of the tenth switch unit is electrically coupled to the second control signal line and receives the second control signal, and the second terminal of the tenth switch unit is adapted to output the output display data signals;

an eleventh switch unit, having a first terminal, a control terminal, and a second terminal, wherein the first terminal of the eleventh switch unit is electrically coupled to the first terminal of the tenth switch unit, the control terminal of the eleventh switch unit is electrically coupled to the third control signal line and receives the third control signal, and the second terminal of the eleventh switch unit is adapted to output the output display data signals; and a twelfth switch unit, having a first terminal, a control terminal, and a second terminal, wherein the first terminal of the twelfth switch unit is electrically coupled to the first terminal of the tenth switch unit and the first terminal of the eleventh switch unit, the control terminal of the twelfth switch unit is electrically coupled to the first control signal line and receives the first control signal, and the second terminal of the twelfth switch unit is adapted to output the output display data signals;

a fifth switching unit, comprising:

a thirteenth switch unit, having a first terminal, a control terminal, and a second terminal, wherein the first terminal of the thirteenth switch unit receives the input display data signals, the control terminal of the thirteenth switch unit is electrically coupled to the third control signal line and receives the third control signal, and the second terminal of the thirteenth switch unit is adapted to output the output display data signals;

a fourteenth switch unit, having a first terminal, a control terminal, and a second terminal, wherein the first terminal of the fourteenth switch unit is electrically coupled to the first terminal of the thirteenth switch unit, the control terminal of the fourteenth switch unit is electrically coupled to the first control signal line and receives the first control signal, and the second terminal of the fourteenth switch unit is adapted to output the output display data signals; and a fifteenth switch unit, having a first terminal, a control terminal, and a second terminal, wherein the first terminal of the fifteenth switch unit is electrically coupled to the first terminal of the thirteenth switch unit and the first terminal of the fourteenth switch unit, the control terminal of the fifteenth switch unit is electrically coupled to the second control signal line and receives the second control signal, and the second terminal of the fifteenth switch unit is adapted to output the output display data signals; and a sixth switching unit, comprising:

a sixteenth switch unit, having a first terminal, a control terminal, and a second terminal, wherein the first terminal of the sixteenth switch unit receives the input display data signals, the control terminal of the sixteenth switch unit is electrically coupled to the third control signal line and receives the third control signal, and the second terminal of the sixteenth switch unit is adapted to output the output display data signals;

a seventeenth switch unit, having a first terminal, a control terminal, and a second terminal, wherein the first terminal of the seventeenth switch unit is electrically coupled to the first terminal of the sixteenth switch unit, the control terminal of the seventeenth switch unit is electrically coupled to the second control signal line and receives the second control signal, and the second terminal of the seventeenth switch unit is adapted to output the output display data signals; and an eighteenth switch unit, having a first terminal, a control terminal, and a second terminal, wherein the first terminal of the eighteenth switch unit is electrically coupled to the first terminal of the sixteenth switch unit and the first terminal of the seventeenth switch unit, the control terminal of the eighteenth switch unit is electrically coupled to the first control signal line and receives the first control signal, and the second terminal of the eighteenth switch unit is adapted to output the output display data signals.

6. The multiplexer according to claim 5, wherein the first switch unit, the fourth switch unit, the seventh switch unit, the tenth switch unit, the thirteenth switch unit, and the sixteenth switch unit are sequentially configured in a first row and are adjacent to each other in a first direction, the second switch unit, the third switch unit, the fifth switch unit, the sixth switch unit, the eighth switch unit, the ninth switch unit, the eleventh switch unit, the twelfth switch unit, the fourteenth switch unit, the fifteenth switch unit, the seventeenth switch unit, and the eighteenth switch unit are sequentially configured in a second row and are adjacent to each other in the first direction, the first switch unit is adjacent to the second switch unit and the third switch unit in a second direction, the fourth switch unit is adjacent to the fifth switch unit and the sixth switch unit in the second direction, the seventh switch unit is adjacent to the eighth switch unit and the ninth switch unit in the second direction, the tenth switch unit is adjacent to the eleventh switch unit and the twelfth switch unit in the second direction, the thirteenth switch unit is adjacent to the fourteenth switch unit and the fifteenth switch unit in the second direction, the sixteenth switch unit is adjacent to the seventeenth switch unit and the eighteenth switch unit in the second direction, the first row is parallel to the second row, the first row is adjacent to the second row in the second direction, the first row is far away from the first control signal line, the second control signal line, and the third control signal line, the third control signal line is more adjacent to the second row than the first control signal line and the second control signal line, and the first control signal line is farther away from the second row than the second control signal line and the third control signal line, wherein the first direction and the second direction are perpendicular to each other.

7. The multiplexer according to claim 5, wherein the first switch unit, the fourth switch unit, the seventh switch unit, the tenth switch unit, the thirteenth switch unit, and the sixteenth switch unit are sequentially configured in a first row and are adjacent to each other in a first direction, the second switch unit, the fifth switch unit, the eighth switch unit, the eleventh switch unit, the fourteenth switch unit, and the seventeenth switch unit are sequentially configured in a second row and are adjacent to each other in the first direction, the third switch unit, the sixth switch unit, the ninth switch unit, the twelfth switch unit, the fifteenth switch unit, and the eighteenth switch unit are sequentially configured in a third row and are adjacent to each other in the first direction, the first row, the second row, and the third row are sequentially arranged in a second direction, the first switch unit, the second switch unit, and the third switch unit are sequentially arranged in the second direction and are adjacent to each other, the fourth switch unit, the fifth switch unit, and the sixth switch unit are sequentially arranged in the second direction and are adjacent to each other, the seventh switch unit, the eighth switch unit, and the ninth switch unit are sequentially arranged in the second direction and are adjacent to each other, the tenth switch unit, the eleventh switch unit, and the twelfth switch unit are sequentially arranged in the second direction and are adjacent to each other, the thirteenth switch unit, the fourteenth switch unit, and the fifteenth switch unit are sequentially arranged in the second direction and are adjacent to each other, the sixteenth switch unit, the seventeenth switch unit, and the eighteenth switch unit are sequentially arranged in the second direction and are adjacent to each other, the first row is farther away from the first control signal line, the second control signal line, and the third control signal line than the second row and the third row, the third row is more adjacent to the first control signal line, the second control signal line, and the third control signal line than the first row and the second row, the third control signal line is more adjacent to the third row than the first control signal line and the second control signal line, and the first control signal line is farther away from the third row than the second control signal line and the third control signal line, wherein the first direction and the second direction are perpendicular to each other.

8. A multiplexer applied to a display device, comprising:

a plurality of switching units, electrically coupled to a data driver and a plurality of pixel units, wherein the switching units are adapted to receive a plurality of input display data signals output by the data driver, and output a plurality of output display data signals to the electrically coupled pixel units, wherein each respective switching unit of the switching units defines a plurality of configuration locations within the respective switching unit and comprises a plurality of switch units one-to-one configured at the configuration locations within the respective switching unit, the configuration locations of the switch units within each of the switching units are different from one another, the configuration locations of the switch units defined in each of the switching units are the same as, and at least two of the switch units configured at a same configuration location in the different switching units are electrically coupled to different control signal lines and have different wiring lengths, wherein the wiring lengths are distances between the switch units and the control signal lines.

9. The multiplexer according to claim 8, comprising:

a first switching unit, comprising:

a first switch unit, having a first terminal, a control terminal, and a second terminal, wherein the first terminal of the first switch unit receives the input display data signals, the control terminal of the first switch unit is electrically coupled to a first control signal line, the second terminal of the first switch unit outputs the output display data signals, and the control terminal of the first switch unit is at a distance of a first wiring length from the first control signal line; and a second switch unit, having a first terminal, a control terminal, and a second terminal, wherein the first terminal of the second switch unit is electrically coupled to the first terminal of the first switch unit, the control terminal of the second switch unit is electrically coupled to a second control signal line, the second terminal of the second switch unit outputs the output display data signals, and the control terminal of the second switch unit is at a distance of a second wiring length from the second control signal line; and a second switching unit, adjacent to the first switching unit in a first direction, and comprising:

a third switch unit, having a first terminal, a control terminal, and a second terminal, wherein the first terminal of the third switch unit receives the input display data signals, the control terminal of the third switch unit is electrically coupled to the second control signal line, the second terminal of the third switch unit outputs the output display data signals, and the control terminal of the third switch unit is at a distance of a third wiring length from the second control signal line; and a fourth switch unit, having a first terminal, a control terminal, and a fourth terminal, wherein the first terminal of the fourth switch unit is electrically coupled to the first terminal of the third switch unit, the control terminal of the fourth switch unit is electrically coupled to the first control signal line, the second terminal of the fourth switch unit outputs the output display data signals, and the control terminal of the fourth switch unit is at a distance of a fourth wiring length from the first control signal line.

10. The multiplexer according to claim 9, wherein the second wiring length and the third wiring length are greater than the first wiring length and the fourth wiring length.

11. The multiplexer according to claim 9, wherein the third wiring length is greater than the first wiring length, the first wiring length is greater than the second wiring length, and the second wiring length is greater than the fourth wiring length.

12. The multiplexer according to claim 8, comprising:

a first switching unit, comprising:

a first switch unit, having a first terminal, a control terminal, and a second terminal, wherein the first terminal of the first switch unit receives the input display data signals, the control terminal of the first switch unit is electrically coupled to a first control signal line, the second terminal of the first switch unit is adapted to output the output display data signals, and the control terminal of the first switch unit is at a distance of a first wiring length from the first control signal line;

a second switch unit, having a first terminal, a control terminal, and a second terminal, wherein the first terminal of the second switch unit is electrically coupled to the first terminal of the first switch unit, the control terminal of the second switch unit is electrically coupled to a second control signal line, the second terminal of the second switch unit is adapted to output the output display data signals, and the control terminal of the second switch unit is at a distance of a second wiring length from the second control signal line; and a third switch unit, having a first terminal, a control terminal, and a second terminal, wherein the first terminal of the third switch unit is electrically coupled to the first terminal of the first switch unit and the first terminal of the second switch unit, the control terminal of the third switch unit is electrically coupled to a third control signal line, the second terminal of the third switch unit is adapted to output the output display data signals, and the control terminal of the third switch unit is at a distance of a third wiring length from the third control signal line;

a second switching unit, comprising:

a fourth switch unit, having a first terminal, a control terminal, and a second terminal, wherein the first terminal of the fourth switch unit receives the input display data signals, the control terminal of the fourth switch unit is electrically coupled to the first control signal line, the second terminal of the fourth switch unit is adapted to output the output display data signals, and the control terminal of the fourth switch unit is at a distance of a fourth wiring length from the first control signal line;

a fifth switch unit, having a first terminal, a control terminal, and a second terminal, wherein the first terminal of the fifth switch unit is electrically coupled to the first terminal of the fourth switch unit, the control terminal of the fifth switch unit is electrically coupled to the third control signal line, the second terminal of the fifth switch unit is adapted to output the output display data signals, and the control terminal of the fifth switch unit is at a distance of a fifth wiring length from the third control signal line; and a sixth switch unit, having a first terminal, a control terminal, and a second terminal, wherein the first terminal of the sixth switch unit is electrically coupled to the first terminal of the fourth switch unit and the first terminal of the fifth switch unit, the control terminal of the sixth switch unit is electrically coupled to the second control signal line, the second terminal of the sixth switch unit is adapted to output the output display data signals, and the control terminal of the sixth switch unit is at a distance of a sixth wiring length from the second control signal line;

a third switching unit, comprising:

a seventh switch unit, having a first terminal, a control terminal, and a second terminal, wherein the first terminal of the seventh switch unit receives the input display data signals, the control terminal of the seventh switch unit is electrically coupled to the second control signal line, the second terminal of the seventh switch unit is adapted to output the output display data signals, and the control terminal of the seventh switch unit is at a distance of a seventh wiring length from the second control signal line;

an eighth switch unit, having a first terminal, a control terminal, and a fourth terminal, wherein the first terminal of the eighth switch unit is electrically coupled to the first terminal of the seventh switch unit, the control terminal of the eighth switch unit is electrically coupled to the first control signal line, the second terminal of the eighth switch unit is adapted to output the output display data signals, and the control terminal of the eighth switch unit is at a distance of an eighth wiring length from the first control signal line; and a ninth switch unit, having a first terminal, a control terminal, and a second terminal, wherein the first terminal of the ninth switch unit is electrically coupled to the first terminal of the seventh switch unit and the first terminal of the eighth switch unit, the control terminal of the ninth switch unit is electrically coupled to the third control signal line, the second terminal of the ninth switch unit is adapted to output the output display data signals, and the control terminal of the ninth switch unit is at a distance of a ninth wiring length from the third control signal line;

a fourth switching unit, comprising:

a tenth switch unit, having a first terminal, a control terminal, and a second terminal, wherein the first terminal of the tenth switch unit receives the input display data signals, the control terminal of the tenth switch unit is electrically coupled to the second control signal line, the second terminal of the tenth switch unit is adapted to output the output display data signals, and the control terminal of the tenth switch unit is at a distance of a tenth wiring length from the second control signal line;

an eleventh switch unit, having a first terminal, a control terminal, and a second terminal, wherein the first terminal of the eleventh switch unit is electrically coupled to the first terminal of the tenth switch unit, the control terminal of the eleventh switch unit is electrically coupled to the third control signal line, the second terminal of the eleventh switch unit is adapted to output the output display data signals, and the control terminal of the eleventh switch unit is at a distance of an eleventh wiring length from the third control signal line; and a twelfth switch unit, having a first terminal, a control terminal, and a second terminal, wherein the first terminal of the twelfth switch unit is electrically coupled to the first terminal of the tenth switch unit and the first terminal of the eleventh switch unit, the control terminal of the twelfth switch unit is electrically coupled to the first control signal line, the second terminal of the twelfth switch unit is adapted to output the output display data signals, and the control terminal of the twelfth switch unit is at a distance of a twelfth wiring length from the first control signal line;

a fifth switching unit, comprising:

a thirteenth switch unit, having a first terminal, a control terminal, and a second terminal, wherein the first terminal of the thirteenth switch unit receives the input display data signals, the control terminal of the thirteenth switch unit is electrically coupled to the third control signal line, the second terminal of the thirteenth switch unit is adapted to output the output display data signals, and the control terminal of the thirteenth switch unit is at a distance of a thirteenth wiring length from the third control signal line;

a fourteenth switch unit, having a first terminal, a control terminal, and a second terminal, wherein the first terminal of the fourteenth switch unit is electrically coupled to the first terminal of the thirteenth switch unit, the control terminal of the fourteenth switch unit is electrically coupled to the first control signal line, the second terminal of the fourteenth switch unit is adapted to output the output display data signals, and the control terminal of the fourteenth switch unit is at a distance of a fourteenth wiring length from the first control signal line; and a fifteenth switch unit, having a first terminal, a control terminal, and a second terminal, wherein the first terminal of the fifteenth switch unit is electrically coupled to the first terminal of the thirteenth switch unit and the first terminal of the fourteenth switch unit, the control terminal of the fifteenth switch unit is electrically coupled to the second control signal line, the second terminal of the fifteenth switch unit is adapted to output the output display data signals, and the control terminal of the fifteenth switch unit is at a distance of a fifteenth wiring length from the second control signal line; and a sixth switching unit, comprising:

a sixteenth switch unit, having a first terminal, a control terminal, and a second terminal, wherein the first terminal of the sixteenth switch unit receives the input display data signals, the control terminal of the sixteenth switch unit is electrically coupled to the third control signal line, the second terminal of the sixteenth switch unit is adapted to output the output display data signals, and the control terminal of the sixteenth switch unit is at a distance of a sixteenth wiring length from the third control signal line;

a seventeenth switch unit, having a first terminal, a control terminal, and a second terminal, wherein the first terminal of the seventeenth switch unit is electrically coupled to the first terminal of the sixteenth switch unit, the control terminal of the seventeenth switch unit is electrically coupled to the second control signal line, the second terminal of the seventeenth switch unit is adapted to output the output display data signals, and the control terminal of the seventeenth switch unit is at a distance of a seventeenth wiring length from the second control signal line; and an eighteenth switch unit, having a first terminal, a control terminal, and a second terminal, wherein the first terminal of the eighteenth switch unit is electrically coupled to the first terminal of the sixteenth switch unit and the first terminal of the seventeenth switch unit, the control terminal of the eighteenth switch unit is electrically coupled to the first control signal line, the second terminal of the eighteenth switch unit is adapted to output the output display data signals, and the control terminal of the eighteenth switch unit is at a distance of an eighteenth wiring length from the first control signal line.

13. The multiplexer according to claim 12, wherein the first wiring length and the fourth wiring length are greater than the seventh wiring length and the tenth wiring length, the seventh wiring length and the tenth wiring length are greater than the thirteenth wiring length and the sixteenth wiring length, the thirteenth wiring length and the sixteenth wiring length are greater than the eighth wiring length, the twelfth wiring length, the fourteenth wiring length, and the eighteenth wiring length, the eighth wiring length, the twelfth wiring length, the fourteenth wiring length, and the eighteenth wiring length are greater than the second wiring length, the sixth wiring length, the fifteenth wiring length, and the seventeenth wiring length, and the second wiring length, the sixth wiring length, the fifteenth wiring length, and the seventeenth wiring length are greater than the third wiring length, the fifth wiring length, the ninth wiring length, and the eleventh wiring length.

14. The multiplexer according to claim 12, wherein the first wiring length and the fourth wiring length are greater than the seventh wiring length and the tenth wiring length, the seventh wiring length and the tenth wiring length are greater than the thirteenth wiring length and the sixteenth wiring length, the thirteenth wiring length and the sixteenth wiring length are greater than the eighth wiring length and the seventeenth wiring length, the eighth wiring length and the seventeenth wiring length are greater than the second wiring length and the fourteenth wiring length, the second wiring length and the fourteenth wiring length are greater than the fifth wiring length and the eleventh wiring length, the fifth wiring length and the eleventh wiring length are greater than the twelfth wiring length and the eighteenth wiring length, the twelfth wiring length and the eighteenth wiring length are greater than the sixth wiring length and the fifteenth wiring length, and the sixth wiring length and the fifteenth wiring length are greater than the third wiring length and the ninth wiring length.

15. A multiplexer applied to a display device, comprising:

a plurality of switching units, electrically coupled to a data driver and a plurality of pixel units, wherein the switching units are adapted to receive a plurality of input display data signals output by the data driver, and output a plurality of output display data signals to the electrically coupled pixel units, wherein each of the switching units comprises a plurality of switch units, configuration locations of the switch units in each of the switching units are the same as, and some of the switch units configured at a same configuration location in the different switching units are electrically coupled to different control signal lines and have different wiring lengths, wherein the wiring lengths are distances between the switch units and the control signal lines;

wherein the plurality of switching units comprising:

a first switching unit, comprising:

a first switch unit, having a first terminal, a control terminal, and a second terminal, wherein the first terminal of the first switch unit receives the input display data signals, the control terminal of the first switch unit is electrically coupled to a first control signal line, the second terminal of the first switch unit outputs the output display data signals, and the control terminal of the first switch unit is at a distance of a first wiring length from the first control signal line; and a second switch unit, having a first terminal, a control terminal, and a second terminal, wherein the first terminal of the second switch unit is electrically coupled to the first terminal of the first switch unit, the control terminal of the second switch unit is electrically coupled to a second control signal line, the second terminal of the second switch unit outputs the output display data signals, and the control terminal of the second switch unit is at a distance of a second wiring length from the second control signal line; and a second switching unit, adjacent to the first switching unit in a first direction, and comprising:

a third switch unit, having a first terminal, a control terminal, and a second terminal, wherein the first terminal of the third switch unit receives the input display data signals, the control terminal of the third switch unit is electrically coupled to the second control signal line, the second terminal of the third switch unit outputs the output display data signals, and the control terminal of the third switch unit is at a distance of a third wiring length from the second control signal line; and a fourth switch unit, having a first terminal, a control terminal, and a fourth terminal, wherein the first terminal of the fourth switch unit is electrically coupled to the first terminal of the third switch unit, the control terminal of the fourth switch unit is electrically coupled to the first control signal line, the second terminal of the fourth switch unit outputs the output display data signals, and the control terminal of the fourth switch unit is at a distance of a fourth wiring length from the first control signal line;

wherein the second wiring length and the third wiring length are greater than the first wiring length and the fourth wiring length.

* * * * *